US010285523B2

(12) United States Patent
Pugsley

(10) Patent No.: US 10,285,523 B2
(45) Date of Patent: May 14, 2019

(54) RACE HYDRATION SYSTEM

(71) Applicant: Raymond F. Pugsley, Potomac Falls, VA (US)

(72) Inventor: Raymond F. Pugsley, Potomac Falls, VA (US)

( * ) Notice: Subject to any disclaimer, the term of this patent is extended or adjusted under 35 U.S.C. 154(b) by 357 days.

(21) Appl. No.: 15/046,910

(22) Filed: Feb. 18, 2016

(65) Prior Publication Data

US 2016/0235188 A1 Aug. 18, 2016

Related U.S. Application Data

(60) Provisional application No. 62/117,498, filed on Feb. 18, 2015.

(51) Int. Cl.

| | |
|---|---|
| ***A45F 5/00*** | (2006.01) |
| ***A47G 21/18*** | (2006.01) |
| ***A45F 3/20*** | (2006.01) |
| *A45F 3/16* | (2006.01) |

(52) U.S. Cl.

CPC ..... *A47G 21/18* (2013.01); *A45F 3/20* (2013.01); *A45F 2003/166* (2013.01)

(58) Field of Classification Search

CPC ..... A45F 5/02; A45F 2200/0566; A45F 2003/166; A45F 3/20; A45F 2005/006; A45F 5/00; A41B 9/06; A41D 1/04; A61J 7/0038; A47G 21/18

USPC ..... 224/148.2, 194, 182, 901, 902; 401/131; 206/5

See application file for complete search history.

(56) References Cited

U.S. PATENT DOCUMENTS

| | | | | |
|---|---|---|---|---|
| 3,128,514 | A * | 4/1964 | Parker | A44B 18/00 2/300 |
| 5,060,833 | A | 10/1991 | Edison et al. | |
| 5,140,723 | A * | 8/1992 | Genzel | B43K 23/001 24/10 R |
| 5,207,719 | A | 5/1993 | Janus | |
| 5,301,860 | A * | 4/1994 | Paczonay | B62J 11/00 224/414 |
| 5,335,851 | A | 8/1994 | Kdaska et al. | |

(Continued)

FOREIGN PATENT DOCUMENTS

| | | | | |
|---|---|---|---|---|
| DE | 10238545 | A1 | 3/2002 | |
| DE | 10238545 | A1 * | 3/2004 | A45F 5/00 |

*Primary Examiner* — Nathan J Newhouse
*Assistant Examiner* — Matthew T Theis
(74) *Attorney, Agent, or Firm* — Joan K. Lawrence

(57) ABSTRACT

An improved race hydration system and method are provided that will enable runners and other athletes participating in competitive events using the system and method to easily and quickly access hydrating fluids without interfering with their competition pace or stride. The system may be formed from lightweight disposable components and is designed to be worn by the athlete without discomfort or distraction during competition. A hydration assembly, including a straw element with attachment structures, may be removably attached to the athlete's clothing by an attachment assembly. The straw element has a length and diameter that permits the athlete to obtain a maximum amount of hydrating fluid from an open top container while continuing to maintain a desired pace and stride. The hydration assembly is secured in place when it is not being used at an attachment assembly location that is easily accessed by the athlete when needed.

19 Claims, 2 Drawing Sheets

(56) References Cited

U.S. PATENT DOCUMENTS

| | | | | |
|---|---|---|---|---|
| 5,755,368 | A | 5/1998 | Bekkedahl | |
| 6,283,344 | B1 * | 9/2001 | Bradley | A42B 1/24 222/175 |
| 6,581,811 | B1 | 6/2003 | Schillaci | |
| 8,397,962 | B1 * | 3/2013 | O'Connell | A45F 3/20 224/148.1 |
| 8,595,867 | B1 * | 12/2013 | Zinna | A45C 13/123 2/244 |
| 2010/0133307 | A1 * | 6/2010 | Martin | A45F 5/00 224/257 |

* cited by examiner

Fig. 1
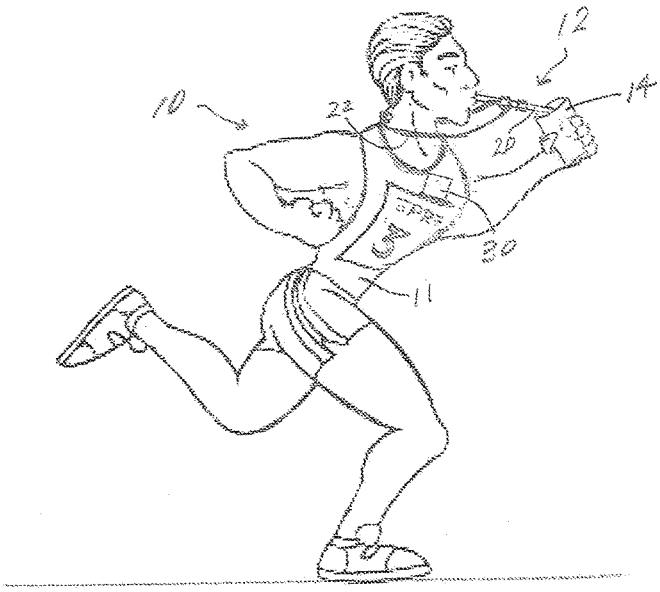
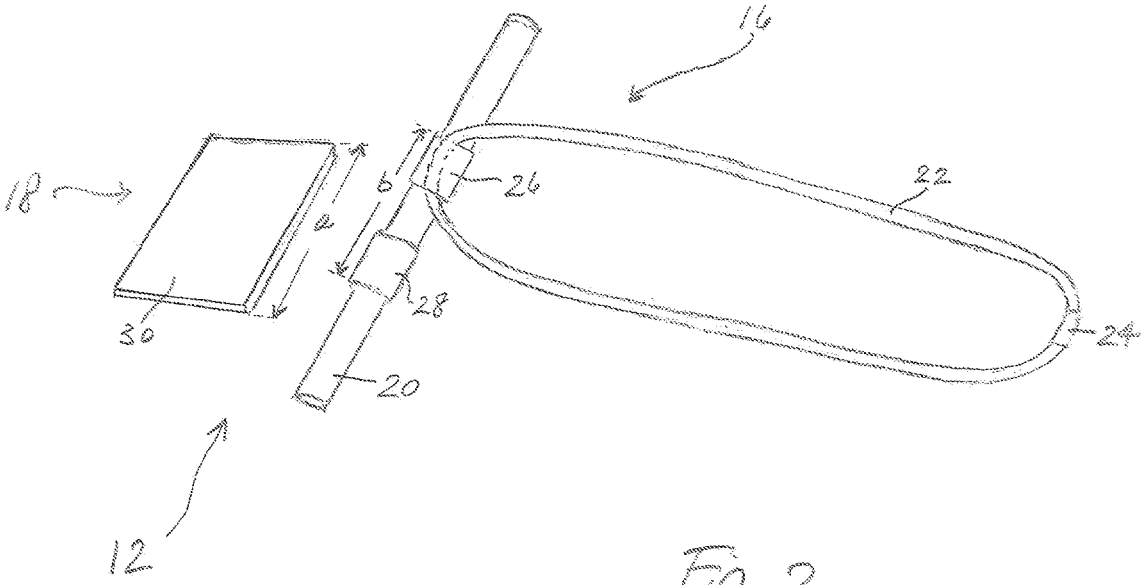
Fig. 2

Fig. 3
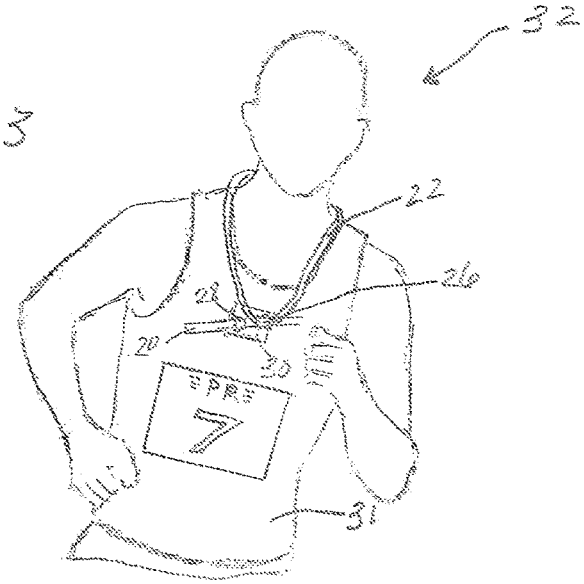
Fig. 4
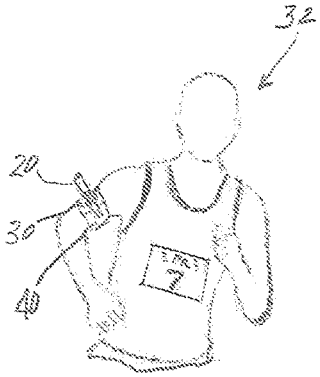
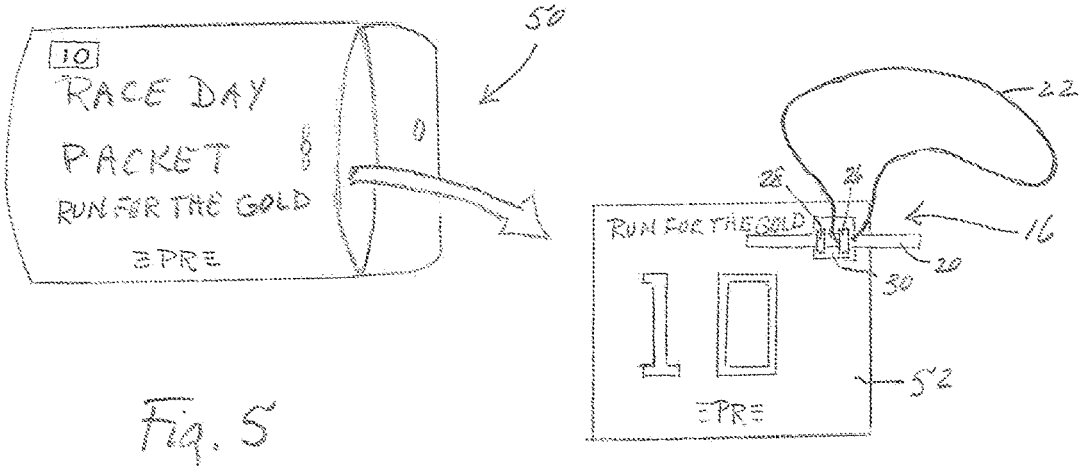
Fig. 5

RACE HYDRATION SYSTEM

PRIORITY CLAIM

This application claims priority from U.S. Provisional Application No. 62/117,498, filed 18 Feb. 2015, the disclosure of which is fully incorporated herein.

TECHNICAL FIELD

The present invention relates generally to hydration systems for ensuring that athletes competing in races or like athletic competitions obtain and maintain adequate hydration during competition and specifically to an improved race hydration system that may be used by runners and other athletes during competition to optimize hydration while minimizing the time and effort required for hydration.

BACKGROUND OF THE INVENTION

The importance of maintaining adequate hydration during athletic competition is widely recognized. Athletes with a range of experience and abilities are well aware that their performance and well-being may be adversely affected if they do not consume sufficient fluids to avoid dehydration. The diverse nature of specific athletic competitions has led to diverse ways in which hydrating fluids are made available to and consumed by the athletes participating in these competitions.

A number of different hydration devices have been proposed that enable cyclists to obtain hydrating fluids and maintain hydration during both competition and training some of these devices have also been adapted for use by those participating in other sports, including hiking, inline skating, canoeing, kayaking, rowing, cross-country skiing, and similar endurance sports activities that may involve moving long distances through areas where hydrating fluids may not be readily available. U.S. Pat. No. 5,060,833 to Edison; U.S. Pat. No. 5,755,368 to Bekkedahl; and U.S. Pat. No. 6,283,344 to Bradley are examples of hydration systems that rely on a bicycle-mounted or a back-mounted fluid container that may be accessed by the athlete using a flexible tube connected to the container. Although such devices and systems may be accessed by the athlete to take in fluids without stopping the athletic activity, the flexible tube connected to the container may not always be readily available and may require some effort by the athlete to locate so that fluid can be drawn into the mouth. This problem has been addressed by providing various structures that keep the mouth end of the flexible tube located on the athlete's head, for example attached to a helmet, as shown by Bradley in U.S. Pat. No. 6,283,344. An additional disadvantage of these devices is that they are not universally useful with fluid containers that are different from those specifically described in the foregoing patents. For example, at points during exercise or competition, an athlete may be handed a container with a sports drink by a coach or a volunteer that the athlete could not access with these systems.

Wearable containers designed for runners and other athletes that improve access to hydrating fluids have also been proposed. Janus describes a "joggers aid" in U.S. Pat. No. 5,207,719 that hangs around the user's neck and is accessed with a straw held in place by projections on the front of the container. The Janus device neck strap and hanging water container, which is likely to bounce against a runner's chest during competition, does not appear to be a comfortable hydration solution. The fluid in the wearable container described by Schallaci in U.S. Pat. No. 6,581,811 must be accessed by removing a cap and drinking from the container after the container has been removed from the athlete's body. Like the Janus device, the Schallaci device does not appear to be a hydration solution likely to appeal to runners interested in obtaining a competitive advantage while maximizing hydration.

Hydration devices and systems similar to those described above may work well to enable runners to stay hydrated during training runs. However, runners face challenges obtaining adequate hydration without compromising performance during road races and like competitions. The current practice for the vast majority of road and trail races is to provide water stops located at intervals along the race course. At water stops, race personnel or volunteers maintain a supply of open top cups, typically on a table or other flat surface. As a runner passes a water stop, she or he may pick up a cup of water or other hydrating fluid from the table or be handed a cup of water by a person at the water stop. To minimize the time spent in obtaining a cup of water, the runner usually grabs the cup as quickly as possible while still running. It is very difficult to drink from an open top cup of liquid while continuing to maintain a running pace without spilling much of the water or inhaling it through the nose. A runner must stop running to drink a maximum amount of the liquid in the cup or risk choking. In the first situation, the runner may not obtain an adequate amount of fluid to meet hydration needs and may have to adjust her or his stride and pace. In the second situation, the time it takes the runner to stop and drink breaks the runner's stride and pace and adds to the time it will take the runner to get back on pace and, ultimately, finish the race. In a short race, such as a 5 K (kilometers) competition, the amount of water consumed may be adequate or the time required to drink may be made up during the race. A longer race, for example a 10 K or 10 mile race, a half marathon, or a marathon, with more water stops may present different challenges. The water lost while drinking on the run may affect a runner's hydration level as well as the runner's race pace, or the time required to stop and drink will adversely affect the runner's race time.

To minimize race time spent at water stops and maximize fluid intake, some runners carry a short drinking straw with them to insert into the cups of fluid available at water stops. While this practice has been somewhat helpful, a runner must constantly be aware of where the straw is when she or he approaches a water stop. A straw held in a runner's hand or stuck in a waistband or other clothing structure may be uncomfortable and is easily lost and, therefore, unavailable when needed. Straws designed to be used by runners during competitions are described in U.S. Pat. No. 5,335,851 by Adaska et al and in German Patent Application Publication DE10238545A1 by Wipper. The Adaska et al drinking straw is bendable and includes a circular apertured mouthpiece curved to contact the user's lips toward one end and a clip at an opposite end intended to fasten the straw to the user's clothing when not in use. This design will be awkward to use when a runner is focused on running a competitive race and not on which end of a straw should be inserted in the mouth or in the cup of fluid obtained from a water stop. If the runner grabs the straw at a water stop and inadvertently attempts to insert the straw with the clip end in the mouth and the mouthpiece end in the cup, the result could be a cut lip or mouth from the clip, which is shown to resemble a typical pen or pencil clip in shape. Depending on the size of the fluid cups available, the mouthpiece may or may not fit all the way in the cup, potentially limiting the amount of fluid that may be accessed through the straw. Further, the straw clip proposed is required to be attached to a user's clothing, and suitable attachment locations are very limited on the race clothing worn by most runners. Unless a clip exerts a sufficiently strong spring action to hold it in place on a runner's race clothing, moreover, it could be easily lost. A spring action strong enough to hold the straw in place may also make it more difficult for a runner to remove when approaching a water stop.

The device described and shown by Wipper, intended to permit a runner to continue running while drinking, includes a straw adapted to be supported by a connecting piece attached to a string, cord, or chain and hung around the runner's neck. The Wipper device may overcome some of the challenges presented by the devices described above, but additional challenges remain. Since the Wipper device hangs around a runner's neck, it will move freely and bounce against the chest during a race. Wipper suggests that a connection point may be provided to attach the straw to the user's clothes. Other than showing a possible location for such a connection point, there is no disclosure either of specific structure for achieving such a connection or of how a connection between the structure shown and a runner's clothing may be made. Unless the Wipper device is attached to a runner by more than a neck cord, it is likely to be more of a hindrance than a help during a race, as the straw on the neck cord could end up with the cord in front and the straw in back or uncomfortably wrapped around the runner's neck. In neither situation would a runner in a race be able to effectively use the straw to drink fluids without first thinking about untangling it and/or moving it into a position that will enable the runner to drink. It could be difficult for a runner trying to position a straw to maintain a desired pace and stride while obtaining fluid needed for adequate hydration.

The prior art, therefore, has failed to provide a race hydration system for athletes, particularly runners, for use during competition that effectively enables the athlete to obtain optimal hydration while permitting the athlete to maintain a desired race pace and/or speed. A need exists for such a race hydration system.

SUMMARY OF THE INVENTION

It is a primary object of the present invention, therefore, to overcome the disadvantages of the prior art and to provide an improved race hydration system for athletes, particularly runners, for use during competition that effectively enables the athlete to obtain optimal hydration while permitting the athlete to maintain a desired race pace and/or speed.

It is another object of the present invention to provide an improved race hydration system that is designed to be worn by a runner during a race and to be easily and quickly used by a runner wearing the system to access and drink hydrating fluids available during a race without interfering with the runner's stride or race pace.

It is an additional object of the present invention to provide an improved race hydration system designed to be worn by athletes during competition that is light weight and comfortable and may be worn and used without distractions during competition.

It is a further object of the present invention to provide an improved race hydration system that may be attached to different locations on a competing athlete, including on the athlete's clothing or on an armband worn by the athlete.

It is a further object of the present invention to provide an improved race hydration system with a design that permits its manufacture at lower cost than available hydration systems.

It is a further object of the present invention to provide an improved race hydration system with components that may be reusable or disposable.

It is yet another object of the present invention to provide an improved race hydration system in a race packet kit designed to be distributed to athletes competing in a race.

In accordance with the aforesaid objects, an improved race hydration system is provided that will enable athletes in competitions, particularly runners competing in races, to use the system to easily and quickly access hydrating fluids offered in open top cups throughout a competition or race without interfering with an athlete's competition pace or a runner's stride or race pace. The improved race hydration system of the present invention is formed from lightweight components and is designed to be worn by an athlete without discomfort or distraction during competition. System components may include a hydration assembly and an attachment assembly. The hydration assembly may include a neck cord designed to be comfortably hung around the neck of an athlete and to extend a distance below an athlete's mouth that will facilitate insertion of one end of a straw element attached to the neck cord into the athlete's mouth and the other end of the straw element into a cup of water or other hydrating liquid by the athlete using one hand to hold an open top cup of liquid and the other hand to position the straw. The straw element may be secured to the neck cord by an annular attachment element. A second annular attachment element on the straw element may be provided to secure the hydration assembly, preferably removably, to the attachment assembly, which may be attached to an athlete's racing clothing in a selected location that engages and attaches the straw element where it may be most effectively accessed by the athlete. The hydration assembly may also be attached to an armband or other structure worn by a competing athlete, with or without a neck cord. The improved race hydration system of the present invention may be packaged in a race kit that may be distributed to athletes participating in a race, along with race bibs, shirts, and other items and information typically provided to competing athletes.

Other objects and advantages will be apparent from the following description, drawings, and claims.

BRIEF DESCRIPTION OF THE DRAWINGS

FIG. 1 illustrates a runner competing in a race using the improved race hydration system of the present invention;

FIG. 2 shows the main components of the improved race hydration system of the present invention, including a hydration assembly and an attachment assembly;

FIG. 3 is a diagram of the improved race hydration system worn by an athlete in a location selected to facilitate use of the race hydration system by an athlete during a race;

FIG. 4 shows a second embodiment of the improved race hydration system of the present invention wherein the hydration system is attached to an armband worn by an athlete; and FIG. 5 is a diagram of a portion of a race package intended for distribution to race participants including a kit with the improved race hydration system of the present invention.

DESCRIPTION OF THE INVENTION

Most athletes are aware of the need to maintain adequate hydration during training, and many recognize that maintaining adequate hydration during competition is also necessary for optimal performance. During a short race, such as a 5 K race, a runner may be able to obtain sufficient water or other fluids by drinking directly from the open cups typically offered at water stops, even though much of the fluid may be lost as the runner tries to drink it while continuing to run. An elite runner should be able to complete a 5 K race without requiring water from a water stop, provided she or he is well hydrated before the race and the weather is not uncomfortably hot and humid. Runners who may take more time to complete a 5 K race and may need additional hydration during the race will find the improved hydration system of the present invention useful for ensuring that they are adequately hydrated.

As noted above, it may be more difficult for an athlete to obtain sufficient water or other fluids at multiple water stops during a longer distance competition without compromising performance when water and fluids are distributed, as they currently are, in open top cups. At the present time, fluids are made available and distributed to large numbers of runners and other athletes in road and other races quickly and inexpensively by filling large numbers of open top cups on a table or similar flat surface. The cups may be picked up by the runners or handed off by race personnel as the runners pass a water stop. The goal of the runner at a water stop is to drink as much water as possible without breaking running stride or rhythm. Runners often pick up or request multiple cups of water at water stops during long races or in hot weather to try to obtain adequate fluids, knowing that much water may be lost as the runner tries to drink from the open top cup.

It is easier for an athlete to drink water from an open top cup through a straw while continuing to move than to drink directly from an open top cup without a straw. Most, if not all, of the water in the cup may be consumed through the straw by the athlete without spillage, even while the athlete is moving. Although straw type devices intended to facilitate hydration have been proposed in the art, these devices do not appear to have been produced and do not appear to be available for use by runners or other athletes. Some runners bring their own drinking straws to use during competition, but, as discussed above, this has not proved to be a reliable way to ensure either availability of the straw when needed or adequate race hydration. The present invention provides an improved race hydration system that effectively ensures not only that a maximum amount of water maybe consumed by an athlete, but also that the athlete may rely on the straw being available for use at a water stop when needed. The present hydration system also ensures ease of drinking while an athlete is in motion without the risk of choking.

The improved race hydration system of the present invention is described primarily with respect to its structure and arrangement for use by runners during races to ensure adequate hydration during competition without adversely affecting or compromising race performance and time. The system may also be used by a range of other athletes during competitions or training where water and other hydrating fluids are supplied to competing or training athletes particularly in open top cups or like containers. Although what constitutes adequate or sufficient hydration may vary for different individuals and under different environmental conditions, generally accepted scientific definitions are intended to apply. Most athletes, especially elite athletes, are well aware of what adequate hydration means for them and act accordingly to avoid both under- and over-hydration.

Referring to the drawings, which may not necessarily be drawn to scale, FIG. 1 illustrates a runner 10 using the improved race hydration system 12 of the present invention during a competition. The runner 10 may be passing or have just passed a water stop (not shown) where he was handed a cup 14 containing a hydrating fluid, such as water, an electrolyte replacement fluid, or the like. It will be noted that the runner is maintaining a racing stride while consuming the hydrating liquid.

FIG. 2 illustrates the main components of the improved race hydration system 12 of the present invention. There may be two main components, a hydration assembly 16 and an attachment assembly 18. The hydration assembly 16, which may also have a different configuration than that shown, includes a straw element 20 that is designed to be worn by the athlete. This may be accomplished by providing a neck cord 22 that may have an adjustment element 24 to enable the athlete to adjust the length of the neck cord and secure the cord so that it stays at the desired length. A very long neck cord may be provided that will enable attachment of the hydration assembly to different locations on an athlete and will accommodate different sizes of athletes. Excess cord material may be removed once the neck cord length is properly adjusted. The neck cord 22 may be formed of a number of different materials. The material selected should be one that is comfortable and is not likely to irritate the neck or other body areas contacted by the cord, but has sufficient body to support the straw element 20. The adjustment element 24 may be formed from a material that provides a break away function if pressure in excess of a predetermined safe value is applied to the neck cord 22. In the event of the application of pressure to the neck cord 22 in excess of the predetermined pressure, creating a potentially unsafe condition for the athlete, the adjustment element 24 will break and release the neck cord 22 from the athlete's neck.

The straw element 20 may be any one of a number of available straw designs and is preferably formed from a lightweight food grade plastic material with a diameter selected to enable a moving athlete to suck an amount of liquid through the straw that may be easily swallowed while the athlete is moving and may need to be larger than a conventional drinking straw. A straw diameter that is too small or too large presents challenges: a too small diameter straw may limit the amount of liquid that can be drawn into the mouth, and a too large diameter straw may allow too much liquid to be drawn into the mouth and lead to choking.

The straw element 20 may have a first annular element 26 secured to the straw element 20 at a location selected, as described below, to which the neck cord 22 may be attached. Attachment of the neck cord 22 to the straw element 20 may be done in a number of ways, including by insertion between the straw element 20 and the annular element 26 as shown. Whatever the attachment arrangement selected, the straw element 20 should be securely attached to the neck cord so that the straw element will remain attached to the neck cord for the duration of a race while the straw is being moved as described below to enable the athlete to drink while continuing to move. The straw element 20 may also have a second annular element 28 that is designed to attach the straw element to the attachment assembly 18 when the straw element is not in use. The annular attachment element 26 may also be used to attach the straw element to the attachment assembly 18 as described below.

The neck cord is an important component of the present hydration system. Attachment of the straw element 20 securely to the neck cord 22, whether by an annular attachment 26, as shown and described, or in an equivalent secure manner, ensures that the straw element remains attached to the neck cord at all times. This prevents the athlete from dropping the straw element 20 on the ground at a water station or at any other time during the competition and having to break stride, stop, and pick up the straw element.

With the hydration system described herein, if the straw element 20 slips from the athlete's hand, the attachment of the straw element to the neck cord 22 by attachment element 26 will prevent the straw element from falling farther than the length of the neck cord 22. The athlete will be able to easily retrieve the straw element 20 and use it to drink while continuing to move at a desired pace and stride.

The improved race hydration system attachment assembly 18 includes a patch 30 that is designed to be secured to a location where the straw element 20 may be attached and held in place when the athlete does not need to use the straw element for hydration. The selected location should be one where a runner or other athlete may readily grasp and remove the straw element and place one end in a cup of liquid and the other end in the mouth without losing focus on running stride or pace or having to stop moving. A range of different locations may be used, for example on a runner's shirt, as shown in FIGS. 1 and 3, or on an armband, as shown in FIG. 4. It will be noted that the patch 30 is placed somewhat to the left of center on the shirt ii of the runner 10 in FIG. 1 and in the center of the shirt 31 of the runner 32 in FIG. 3. The specific location will be a matter of individual preference and ease of accessibility of the straw element and may also depend on whether a runner is right or left handed. If a runner elects not to wear a shirt, the patch 30 could be located on the runner's shorts (not shown). In this case, a longer neck cord is likely to be required.

The patch 30 and the annular elements 26 and 28 attached to the straw element 20 are preferably made of a material that permits the annular elements to securely, but removably, adhere to the patch so that the straw element 20 may be easily removed from the patch for use and then replaced after use. A hook and loop type of material, including that sold as VELCRO®, may be especially suitable for this purpose, although equivalent materials are contemplated to be within the scope of the present invention. The material selected must provide a sufficiently secure attachment between the straw element 20 and the patch 30 so that the straw element remains securely attached while an athlete is moving vigorously and must also release the straw element 20 without requiring the exertion of an amount of force that causes the athlete to be distracted from the competition. Materials with these characteristics will be suitable for forming the patch 30 and the annular elements 26 and 28.

To provide a more secure attachment between the patch 30 and the straw element 20, the patch 30 may have a size that ensures that both annular elements 26 and 28 will contact and be held by the patch 30 when the straw element 20 is attached to the patch 30 in different orientations. One example of a straw element orientation is that shown in FIG. 3. To achieve this optimum attachment, at least one dimension, for example dimension a of the patch 30, should be greater than or at least equal to the distance b between the outermost extents of the annular elements 26 and 28 along the straw element 20, as shown in FIG. 2. If both dimensions of the patch 30 are equal to dimension a, then the straw element 20 may be secured to the patch 30 in a greater number of different orientations than are possible with a smaller patch.

The patch 30 may be attached to an athlete's clothing in a number of ways. Race bibs that display an athlete's race number are usually supplied with safety pins to allow attachment of the race bib to a selected article of clothing, such as a shirt as shown in FIGS. 1 and 30. One or more additional safety pins may also be supplied to attach the patch 30 to a desired location. The patch 30 may also be formed with an adhesive backing covered by a release sheet that is removed by the athlete to apply the patch to the desired location. A suitable adhesive backing may employ an adhesive that adheres to fabrics of the type that are used to construct clothing used for athletic competition. A patch 30, particularly one formed of a hook and loop type of material, could also be sewn to an athlete's competition shirt or shorts. This method of attachment may appeal to athletes who tend to wear a limited number of shirts or shorts for competition. Other suitable means for attaching the patch 30 so that it functions as described herein are also contemplated to be within the scope of the present invention.

FIG. 3 illustrates a runner 32 running while the hydration assembly 16 is attached to the attachment assembly 18. The patch 30 is secured to the runner's shirt 31 in a convenient location for the runner 32 so that it will hold the straw element 20 in place as shown in an orientation that does not interfere with the runner's arm movements or otherwise irritate or distract the runner. The straw element 20 is held securely in place on the patch 30 by both annular elements 26 and 28 until the straw is needed by the runner when a cup of liquid is obtained at a water stop.

FIG. 4 illustrates a second embodiment of the present improved race hydration system. Many runners and other athletes are accustomed to wearing an armband that supports a mobile phone or an MP3-type music player so that they can listen to music while they run. In the embodiment of the improved race hydration system shown in FIG. 4, the runner 32 is wearing an armband 40 that supports the hydration system. A patch 30 is attached to the armband 40, and a straw element 20 is attached, preferably using the annular elements 26 and 28 as described above, to the patch 30. If desired to increase the security of the attachment of the system to the runner, a neck cord (not shown) may be attached to one of the annular elements, as shown in FIG. 2. The addition of a neck cord may work better for some runners than others. Since the runners who train with armband-supporting mobile phones or music players typically use headsets or ear buds to hear the music, a neck cord may feel familiar and would not be likely to be a distraction. A neck cord, such as neck cord 22 in FIGS. 1-3 and 5, has the added advantage of keeping the straw element 20 within the runner's reach in the event that the straw element slips out of the runner's grasp. As discussed above, the runner will not have to stop to retrieve a dropped straw element 20 and can maintain a desired stride and pace.

FIG. 5 illustrates a race packet kit 50 of the type that is customarily provided to runners with race information, race T-shirts, race bibs, and the like when runners register prior to a race. It is contemplated that the race packet kit 50 may additionally include an improved race hydration system 16, with the patch 30 either removably or permanently attached to a race bib 52. The straw element 20 may be attached to the patch 30 as shown. Instructions for using the improved race hydration system may also be included in the race packet kit. It is contemplated that the components of the improved race hydration system may be made of materials that are inexpensive as well as disposable and will not add significantly to the cost of the race packet kit contents that are already currently supplied to competitors.

The improved race hydration system of the present invention may, as described above, be made of preferred materials that enhance its utility. The materials selected may also be sufficiently low in cost to permit system components requiring replacement to be repurchased without hardship.

It is further contemplated that improved race hydration systems as described herein may be made available at water stops during races so that in the unlikely event that a runner has lost the hydration assembly portion of the system or the attachment assembly portion of the system, spares may be picked up. The secure attachment of the straw element 20 to a neck cord 22 and the secure attachment of the patch 30 to a runner's clothing or race bib should minimize the need for spares.

The present invention also contemplates a method for facilitating optimal hydration by a competing or training athlete during an athletic competition or training using the present improved race hydration system. When a competing or training athlete wearing the hydration assembly 16 and attachment assembly 18 of the present system is offered an open top cup or container of hydrating fluid during competition, without stopping, the athlete can take the cup or container in one hand. With the other hand, the athlete can remove the straw element 20, which remains attached to the neck cord 22, from the attachment assembly patch 30 and insert one end of the straw element 20 into the open top container and the opposite end of the straw element 20 into his or her mouth. Without stopping and while continuing to move at a desired pace and/or stride, the athlete may drink a maximum amount of hydrating fluid from the open top container through the straw element 20 without spilling the fluid or choking. Still continuing to move, the athlete may discard the open top container, and quickly replace the straw element 20, which is still attached to the neck cord 22, in a convenient position or orientation on the attachment assembly patch 30. As noted above, even if the athlete drops the straw element 20, its attachment to the neck cord 22 by attachment 26 keeps the straw element within the athlete's reach and prevents a stop to retrieve a dropped straw element from the ground. The loss of the straw element 20 is prevented so that it is available for use at the next fluid station, where the hydration process is repeated the next time the athlete is handed or picks up an open top container of fluid. This hydration process may continue at intervals throughout a competition or training to facilitate optimal hydration.

While the present invention has been described with respect to preferred embodiments, this is not intended to be limiting, and other arrangements and structures that perform the required functions are contemplated to be within the scope of the present invention.

INDUSTRIAL APPLICABILITY

The present invention will find its primary applicability when it is desired to provide an improved race hydration system for athletes, especially runners, competing in races or training where hydrating fluids are provided at intervals during the race or training so that the competitors and training athletes may obtain optimal hydration without adverse effects on race performance or training.

The invention claimed is:

1. An improved race hydration system designed to facilitate athlete hydration from an open container during competition or training without interrupting or compromising competition or training performance, comprising:

a. a hydration assembly comprising a hand held longitudinal straw element with a length and a diameter selected to facilitate hydration from an open container when an athlete is moving, a pair of annular attachment elements secured to and positioned along a length of the longitudinal straw element so that an outermost extent of one of the pair of annular attachment elements is spaced a distance b along said longitudinal straw element from an outermost extent of the other of said pair of annular attachment elements, and an adjustable neck cord secured to one of said annular attachment elements; and b. an attachment assembly comprising a removably or permanently attachable patch positioned in a location easily accessed by one of the athlete's hands, with one patch surface attached to an item of clothing, an armband, or a race bib worn by the athlete and an opposite patch surface forms a secure manually releasable attachment with said pair of annular attachment elements to hold said longitudinal straw element while the athlete is moving, and said patch has at least one dimension a at least equal to or greater than the distance b, thereby maximizing attachment locations and orientations for said longitudinal straw element on said patch.

2. The system of claim 1, wherein each one of said annular attachment elements and said opposite patch surface are made from a hook and loop material.

3. The system of claim 1, wherein said neck cord comprises an adjustment element adapted to adjust said neck cord to a desired length and maintain the neck cord at the desired length.

4. The system of claim 3, wherein said adjustment element comprises a break away safety element formed of a material that will break when a pressure in excess of a predetermined safe pressure is applied to said neck cord.

5. The system of claim 3, wherein at least one of said annular attachment elements on said longitudinal straw element secures said longitudinal straw element to said neck cord so that said longitudinal straw element is prevented from falling a distance greater than said desired length when said longitudinal straw element is not attached to said attachment assembly.

6. The system of claim 3, wherein said item of clothing comprises a shirt or shorts and said patch is removably secured to the athlete's shirt, shorts, or said race bib to hold the longitudinal straw element in a location at the desired length at an orientation selected to facilitate manual removal and use and reattachment of the straw element by the athlete while the athlete is moving.

7. The system of claim 1, wherein said patch is secured to an armband worn by the athlete on an arm selected to facilitate access to the hydration assembly by the one of the athlete's hands.

8. A method for facilitating optimal hydration of a competing or training athlete during competition or training comprising:

a. providing the hydration assembly and the attachment assembly of claim 1;

b. positioning the attachment assembly in the location and attaching the patch surface to the item of clothing, armband, or race bib worn by an athlete, adjusting the adjustable neck cord to a length that comfortably moves the longitudinal straw element between the patch and the athlete's mouth, and attaching the longitudinal straw element attachment elements to the patch;

c. when the athlete wearing the hydration assembly and the attachment assembly is offered an open top container of hydrating fluid during competition, removing the longitudinal straw element from the patch and inserting one end of the longitudinal straw element into the open top container and the opposite end of the longitudinal straw element into the athlete's mouth; and d. drinking a hydrating amount of hydrating fluid from the open top container through the longitudinal straw element, discarding the open top container, and replacing the longitudinal straw element on the patch while continuing to move at a desired running pace or stride.

9. The method of claim 8, further comprising offering the athlete the open top container of hydrating fluid at selected intervals during competition or training and repeating steps c. and d. at the selected intervals, whereby the athlete obtains an amount of hydrating fluid needed to avoid compromising athletic performance during the competition.

10. The method of claim 8, further comprising offering to the athlete the open top container comprising a disposable cup with a hydrating fluid comprising water or an electrolyte fluid.

11. The method of claim 8, further comprising removably or permanently securing the attachment assembly to the item of clothing or to the armband worn on the athlete's arm.

12. The method of claim 8, further comprising providing the hydration assembly and the attachment assembly to a competitive runner in a race kit and removably or permanently attaching the attachment assembly to a race bib in the race kit.

13. The system of claim 1, wherein said patch comprises a rectangle, and said distance a comprises a side of said rectangle.

14. The system of claim 1, wherein said patch comprises a rectangle, and said distance a comprises a diagonal of said rectangle.

15. The system of claim 1, wherein said adjustable neck cord is removably secured to one of said attachment elements.

16. The system of claim 1, wherein said longitudinal straw element, said pair of attachment elements, said adjustable neck cord, and said rectangular patch are reusable or disposable.

17. The system of claim 1, wherein two sides of said rectangular patch have a dimension a at least equal to or greater than the distance b.

18. An improved race hydration system provided in a race packet kit for runners that facilitates runner hydration without requiring a runner to stop running or compromise race performance during a race where hydration fluids are provided to runners in open top containers, comprising:

a. a hydration assembly comprising a longitudinal straw element with a length and a diameter selected to facilitate hydration from an open top container when a runner is running during a race, a pair of attachment elements secured to an exterior circumference of said longitudinal straw element and positioned longitudinally on said longitudinal straw element so that an outermost extent of one of said pair of attachment elements is spaced a distance b from an outermost extent of the other of said pair of attachment elements, and an adjustable neck cord secured to one of said attachment elements;

b. an attachment assembly comprising a rectangular patch with one patch surface removably or permanently attached to a location on a race bib accessible to one of the runner's hands when said race bib is attached to the runner's race clothing and an opposite patch surface that securely holds said pair of attachment elements and said longitudinal straw element while the runner is running and manually releases said pair of attachment elements and said longitudinal straw element without requiring the runner to stop running, wherein said rectangular patch has at least one rectangular dimension a at least equal to or greater than the distance b, thereby maximizing attachment locations and orientations for manually securing said attachment elements and said longitudinal straw element on said patch; and c. a race packet kit comprising at least said race bib, said attachment assembly with said one patch surface of said rectangular patch removably or permanently attached to said location on said race bib, and said hydration assembly pair of attachment elements releasably secured to said opposite patch surface of said attachment assembly rectangular patch.

19. The system of claim 18, wherein said longitudinal straw element, said pair of attachment elements, and said adjustable neck cord of said hydration assembly, and said rectangular patch of said attachment assembly in said race packet kit are disposable.

* * * * *